US006550573B2

(12) United States Patent
Wagner et al.

(10) Patent No.: US 6,550,573 B2
(45) **Date of Patent: *Apr. 22, 2003**

(54) MUFFLER WITH CATALYTIC CONVERTER ARRANGEMENT, AND METHOD

(75) Inventors: Wayne M. Wagner, Apple Valley, MN (US); Marty A. Barris, Lakeville, MN (US); Douglas E. Flemming, Rosemount, MN (US); James C. Rothman, Burnsville, MN (US); Peter A. Betts, Prior Lake, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/945,383

(22) Filed: Aug. 31, 2001

(65) Prior Publication Data

US 2002/0040826 A1 Apr. 11, 2002

Related U.S. Application Data

(63) Continuation of application No. 09/178,905, filed on Oct. 26, 1998, now abandoned, which is a continuation of application No. 08/743,516, filed on Nov. 4, 1996, now Pat. No. 5,828,013, which is a continuation of application No. 08/294,198, filed on Aug. 22, 1994, now abandoned, which is a continuation of application No. 07/889,949, filed on Jun. 2, 1992, now Pat. No. 5,355,973.

(51) Int. Cl.[7] ..... F01N 1/00

(52) U.S. Cl. ..... 181/255; 181/272; 60/299

(58) Field of Search ..... 181/227, 231, 181/232, 240, 252, 255, 258, 264, 269, 272, 273, 282; 60/299, 302

(56) References Cited

U.S. PATENT DOCUMENTS

| | | | |
|---|---|---|---|
| 677,357 | A | 7/1901 | Hyde |
| 2,363,236 | A | 11/1944 | Fluor |

(List continued on next page.)

FOREIGN PATENT DOCUMENTS

| | | | |
|---|---|---|---|
| CA | 721202 | | 11/1965 |
| CA | 796934 | | 10/1968 |
| DE | 673 707 | | 3/1939 |
| DE | 2 314 465 | | 10/1974 |
| DE | 4017267 | A1 | 12/1990 |
| EP | 0 158 625 | A1 | 10/1985 |
| EP | 0 220 484 | A2 | 5/1987 |
| EP | 0 220 505 | A2 | 5/1987 |
| FR | 2197411 | | 3/1974 |
| JP | 57-158917 | | 3/1956 |
| JP | 62-160726 | | 10/1987 |
| JP | 63-140123 | | 9/1988 |
| JP | 3-10016 | | 1/1991 |
| WO | WO 89/01566 | | 2/1989 |
| WO | Wo 93/24744 | | 12/1993 |

*Primary Examiner*—Khanh Dang
(74) *Attorney, Agent, or Firm*—Merchant & Gould P.C.

(57) ABSTRACT

An apparatus for modifying an exhaust stream of a diesel engine is provided. The apparatus includes a muffler arrangement having an exhaust inlet and an exhaust outlet in construct and arrange for sound attenuation therein. The apparatus also includes a catalytic converter arrangement positioned within the muffler arrangement between the exhaust inlet and exhaust outlet. During operation, the exhaust flow is directed both through the muffler arrangement and the catalytic converter arrangement, to advantage.

32 Claims, 6 Drawing Sheets

U.S. PATENT DOCUMENTS

| | | | |
|---|---|---|---|
| 2,721,619 | A | 10/1955 | Cheairs |
| 2,732,913 | A | 1/1956 | Higgins |
| 3,180,712 | A | 4/1965 | Hamblin |
| 3,445,196 | A | 5/1969 | Thomas |
| 3,672,464 | A | 6/1972 | Rowley et al. |
| 3,972,687 | A | 8/1976 | Frietzsche |
| 4,050,903 | A | 9/1977 | Bailey et al. |
| 4,086,063 | A | 4/1978 | Garcea |
| 4,209,493 | A | 6/1980 | Olson |
| 4,368,799 | A | 1/1983 | Wagner |
| 4,393,652 | A | 7/1983 | Munro |
| 4,426,844 | A | 1/1984 | Nakano |
| 4,427,836 | A | 1/1984 | Kowalski et al. |
| 4,541,240 | A | 9/1985 | Munro |
| 4,580,657 | A | 4/1986 | Schmeichel et al. |
| 4,601,168 | A | 7/1986 | Harris |
| 4,632,216 | A | 12/1986 | Wagner et al. |
| 4,851,015 | A | 7/1989 | Wagner et al. |
| 4,866,932 | A | 9/1989 | Morita et al. |
| 4,890,690 | A | 1/1990 | Fischer et al. |
| 4,969,537 | A | 11/1990 | Wagner et al. |
| 5,043,147 | A | 8/1991 | Knight |
| 5,139,107 | A | 8/1992 | Nagai |
| 5,140,813 | A | 8/1992 | Whittenberger |
| 5,170,020 | A | 12/1992 | Kruger et al. |
| 5,321,215 | A | 6/1994 | Kicinski |
| 5,355,973 | A | 10/1994 | Wagner et al. |
| 5,426,269 | A | 6/1995 | Wagner et al. |
| 5,808,245 | A | 9/1998 | Wiese et al. |
| 5,828,013 | A | 10/1998 | Wagner et al. |

MUFFLER WITH CATALYTIC CONVERTER ARRANGEMENT, AND METHOD

This application is a continuation of application Ser. No. 09/178,905, filed Oct. 26, 1998; application Ser. No. 09/178,905 was a continuation of application Ser. No. 08/743,516, filed Nov. 4, 1996, now U.S. Pat. No. 5,828,013; application Ser. No. 08/743,516 was a continuation of application Ser. No. 08/294,198, filed Aug. 22, 1994, now abandoned; application Ser. No. 08/294,198 was a continuation of application Ser. No. 07/889,949, filed Jun. 2, 1992, now U.S. Pat. No. 5,355,973, which application(s) are incorporated herein by reference.

FIELD OF THE INVENTION

The present invention relates to muffler assemblies and in particular to muffler assemblies of a type used to dampen exhaust noise produced by internal combustion engines. The invention specifically concerns such an arrangement having a catalytic converter therein.

BACKGROUND OF THE INVENTION

Catalytic converters have been widely utilized with internal combustion engines, typically gasoline powered engines. In operation an oxidizing catalytic converter comprises a post combuster through which emissions from the internal combustion process are directed. The catalyst promotes the conversion of carbon monoxides and hydrocarbons in the emissions to carbon dioxide and water vapor.

In a typical application, the catalytic converter is located in the exhaust system as close to the exhaust engine manifold as practical. In this manner, advantage is taken of available heat in the exhaust gases to minimize the time lag in reaching the desired operating (reaction) temperature. The typical catalyst is a noble metal such as platinum or palladium.

As indicated above, typically catalytic converters have been utilized with gasoline powered internal combustion engines, rather than diesel engines such as truck engines. There are numerous reasons for this. For example, trucks typically have very limited space for the placement of catalytic equipment in the exhaust system. The largest space available is occupied by the muffler, leaving little if any room for effective placement of a catalytic converter. It is not generally reasonable to reduce the size of the muffler to allow for placement of a converter assembly. This is because reduction in the size of the muffler will generally lead to less sound attenuation and higher backpressure.

In addition, in a diesel powered truck system the acceptable amount of resistance to flow in the exhaust stream is strictly limited. More specifically, an effective muffler system for a diesel engine truck typically provides a backpressure close to the maximum backpressure allowable for efficient engine use. The added backpressure which would be introduced by placement of a conventional catalytic converter arrangement in the exhaust stream (in addition to the conventional muffler) would typically be unacceptably close to (if not over) the maximum backpressure allowable and would reduce fuel efficiency.

Nevertheless, there are reasons why it may be desirable to introduce a catalytic converter into a diesel exhaust flow stream. In particular, the catalyst allows for the oxidation of hydrocarbons in the gaseous phase, thereby reducing the concentration of hydrocarbons in the exhaust stream. Due to the concentration reduction, a lower amount of hydrocarbons would be adsorbed onto the surface of carbonaceous particles or soot in the stream. Thus there will be a mass reduction in the tailpipe emissions, if a catalytic converter can be efficiently utilized.

SUMMARY OF THE INVENTION

According to the present invention an apparatus is provided for modifying an exhaust stream of an engine. Herein the term "modifying" in this context is meant to refer to the conduct of at least two basic operations with respect to the exhaust stream: sound attenuation (muffling); and, catalytic conversion (catalyzed combustion of hydrocarbons in the exhaust gas stream). In typical preferred applications the apparatus is utilized for the modification of an exhaust stream of a diesel engine. In most typical applications, the apparatus is utilized as a muffler arrangement for the diesel engine of a vehicle, such as an over-the-highway truck.

The preferred apparatus according to the present invention comprises a muffler arrangement, a catalytic converter arrangement and flow direction means. The muffler arrangement generally has an exhaust inlet, exhaust outlet and means for sound attenuation. That is, exhaust gas is passed through the muffler arrangement from the inlet end through to the outlet end, with sound attenuation occurring within the muffler.

The catalytic converter arrangement is preferably positioned within the muffler arrangement between the exhaust inlet and the exhaust outlet. In general it is operatively positioned such that as exhaust gas is passed through the muffler arrangement, then passed through the catalytic converter. The catalytic converter is constructed and arranged such that in use it will effect a catalyzed conversion in the exhaust gas flow stream, i.e., oxidation of hydrocarbon components in the exhaust gas flow.

The means for flow direction generally comprises means directing the exhaust gases through the catalytic converter arrangement whenever the gases operably flow through the muffler arrangement from the exhaust inlet to the exhaust outlet. In a typical system this means comprises appropriate construction and configuration for the apparatus so that gas flow cannot bypass the catalytic converter arrangement while passing through the muffler.

A variety of arrangements may be utilized as the means for sound attenuation. Among them are included arrangements utilizing one or more resonating chambers for sound attenuation, within the muffler. Resonating chambers may be positioned both upstream and downstream of the catalytic converter arrangement. In typical constructions, substantial use would be made of downstream resonating chambers (or other downstream acoustic elements) to achieve substantial sound attenuation.

In one preferred apparatus, the means for sound attenuation includes a "sonic choke" arrangement operably positioned within the muffler arrangement, as part of the downstream acoustics. A detailed description of a sonic choke arrangement is provided hereinbelow. In general, a sonic choke arrangement comprises a tube having a converging portion to a neck, with an expanded flange on an end thereof. The expanded flange is positioned on the most upstream end of the sonic choke, with the shape of the choke or tube converging rapidly from the flange to a narrowest portion in the neck, and then with a relatively slow divergence in progression from the neck toward the exhaust outlet.

In selected arrangements according to the present invention the catalytic converter arrangement is operatively positioned between an exhaust inlet and the downstream acoustics. The catalytic converter may comprise a metal foil core having an effective amount of catalyst dispersed thereon. In this context the term "effective amount" is meant to refer to sufficient catalyst to conduct whatever amount of conversion is intended under the operation of the assembly. The term "dispersed thereon" is meant to refer to the catalyst operably positioned on the catalytic converter core, regardless of the manner held in place.

When the catalytic converter arrangement comprises a metal foil core, generally the core comprises corrugated foil coiled in arrangement to form a porous tube having an outer surface. In preferred arrangements, the outer surface is generally cylindrical and an outer protective sheet such as a metal sheet may be positioned around the core outer cylindrical surface. Preferred metal foil cores have a cell density, i.e., population density of passageways therethrough, of at least about 200 cells/in$^2$ and more preferably about 400 cells/in$^2$. Such an arrangement can be formed from corrugated stainless sheeting of about 0.0015 inches (0.001–0.003 inch) thick.

A variety of catalysts may be utilized in assemblies according to the present invention including platinum, palladium, rhodium and vanadium.

In certain alternate embodiments the catalytic converter core may comprise a porous ceramic core. A typical such core will be formed from extruded cordierite (a magnesia alumina silicate) and have an effective amount of catalyst dispersed thereon. Preferably the cell density of passageways through such a ceramic core is at least about 200 cells/in$^2$ and preferably at least about 400 cells/in$^2$.

In preferred arrangements wherein the catalytic converter core comprises ceramic, the ceramic core is provided in a generally cylindrical configuration, with an outer cylindrical surface. The ceramic core is preferably protected by the catalytic converter arrangement being provided with a flexible, insulating mantle wrapped around the core outer surface. The insulating mantle will preferably be secured in place by the positioning of an outer metal wrap therearound. In preferred arrangements the outer metal wrap is provided with side flanges, operably folded over upstream and downstream faces of the catalytic converter core. Preferably a soft, flexible insulating rope gasket is positioned adjacent any such folds or flanges, to inhibit crumbling of the ceramic core during the manufacture and installation process and to provide a seal for the less durable insulating mantle materials.

Preferred arrangements according to the present invention include a flow distribution arrangement constructed and arranged to direct the exhaust flow substantially evenly against the catalytic converter. In particular, the catalytic converter core member may be described as having a most upstream face. Preferably the flow distribution element is constructed and arranged to direct flow relatively evenly across the upstream face of the catalytic converter core member. In one preferred embodiment, which is described and shown the flow distribution element comprises a porous tube having an end with a "star crimp", i.e. a type of folded end closure, therein. In another, a domed, perforated baffle member positioned between the exhaust inlet and the porous core member upstream face serves as a flow distribution element. In still another, curved surfaces are used to generate a radial diffuser inlet.

It has been determined that there is a preferred positioning of the porous core member between the flow distribution element and the downstream acoustics. More specifically, preferably the porous core member is positioned within about 1 inch to 6 inches from the flow distribution element; and, preferably the core member is also positioned within about 1 inch to 6 inches from the re-entrant tube inlet for the downstream acoustics. Also, a preferred open area fraction for the flow distribution element can be defined. Detailed descriptions with respect to this is provided herein below.

In addition, according to the present invention an apparatus for providing a relatively even fluid (typically gas) flow velocity across a conduit (typically having a substantially circular cross section) is provided. In general the apparatus is adapted for generating even flow in a situation in which gases pass into an arrangement through an inlet tube having a first diameter (cross-sectional size) to a chamber having a second diameter (cross-sectional size) greater than the first diameter. Typically, a domed perforated diffusion baffle having a second diameter greater than the first (inlet) diameter, is located downstream from the inlet tube. What is needed, is an arrangement to provide for direction of gases against the domed perforated diffusion baffle in such a manner that as the fluid or gases pass therethrough, an even flow distribution (i.e. velocity of gases or volume of gases directed against any point in cross section) is provided. This is accomplished by positioning a bell shaped radial diffuser element upstream from the domed perforated diffusion baffle and downstream from the inlet tube. The bell shaped radial diffuser element generally comprises an expanding bell having a shape similar to the bell of a musical instrument. Preferred sizes and curvatures are described herein. In general the bell allows for expansion of the gases as they approach the dome perforated diffusion baffle for even flow distribution. Such arrangements may be utilized in a variety of muffler constructions including ones having catalytic converters therein.

The invention also includes within its scope a method of modifying the exhaust stream of a diesel engine for both sound attenuation and catalytic conversion. The method includes a step of conducting catalytic conversion within a muffler assembly. Preferred manners of conducting these steps are provided herein below.

BRIEF DESCRIPTION OF THE DRAWINGS

FIG. 4 presenting an alternate embodiment.

FIG. 5 presenting a second alternate embodiment.

DETAILED DESCRIPTION OF THE INVENTION

As required, a detailed description of preferred and alternate embodiments is presented herein. The description provided is not intended to be limiting, but rather to serve as a presentation by example of embodiments in which the subject matter claimed may be applied.

The General Configuration of the Overall Assembly

Figures 1, 2, 3:
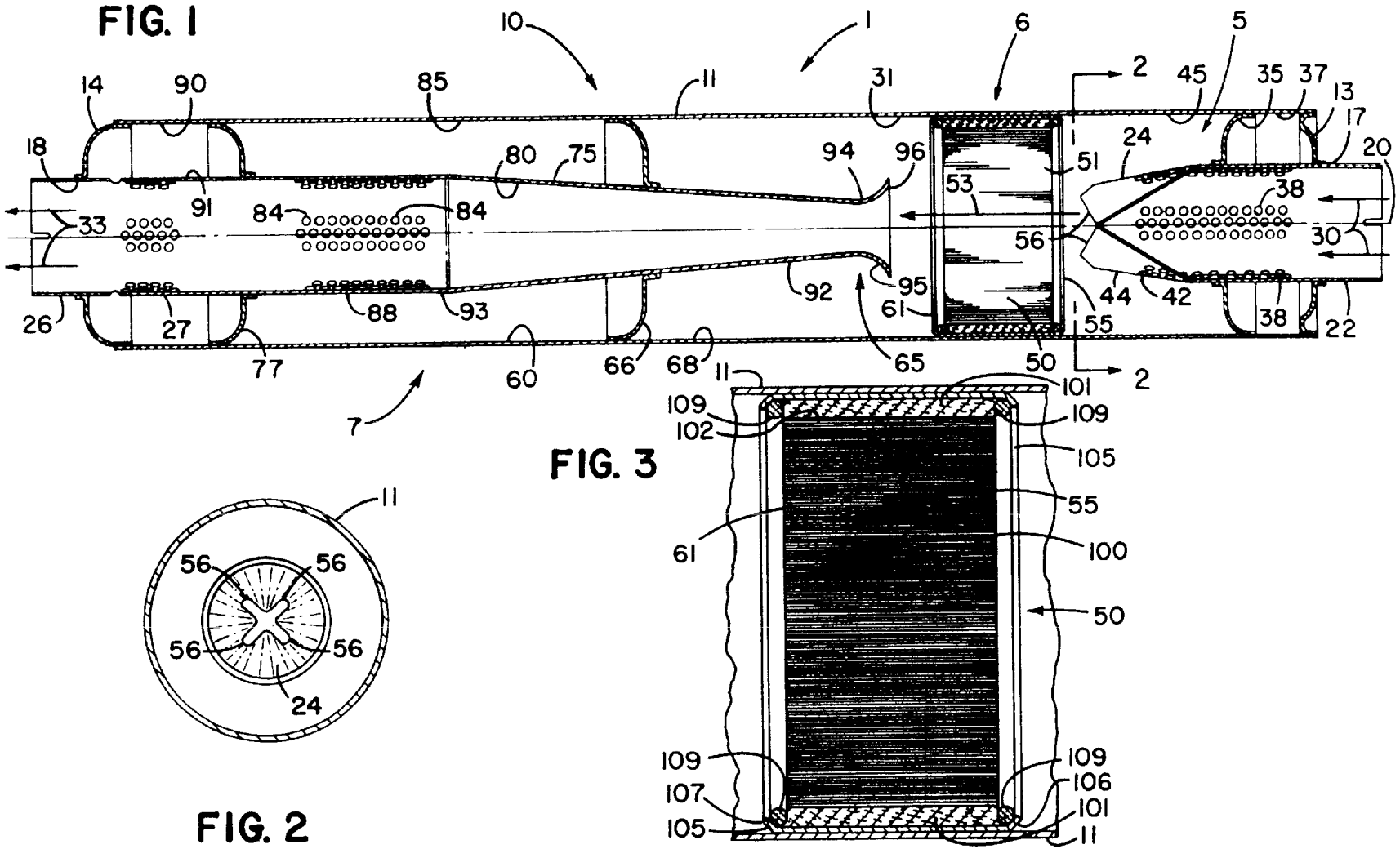
FIG. 1 is a schematic cross-sectional view of a muffler assembly with a catalytic converter arrangement therein according to the present invention.
FIG. 2 is a cross-sectional view taken generally along line 2—2, FIG. 1.
FIG. 3 is an enlarged, fragmentary view of a portion of the arrangement shown in FIG. 1.

The reference numeral 1, FIG. 1, generally designates a muffler assembly according to the present invention. The muffler assembly 1 has defined therein three general regions: an exhaust introduction, distribution and upstream acoustics region 5; a catalytic converter region 6; and a downstream acoustical or attenuation region 7. Each of regions 5, 6 and 7 may be constructed separately, with the overall assembly prepared through utilization of appropriate clamps, segments, etc. However, in preferred applications as shown in FIG. 1, it is foreseen that the segments 5, 6 and 7 will be constructed in an overall unit 10 having an outer shell 11 with no segment seams or cross seams therein. By "cross seam" in this context it is meant that the shell 11 is not segmented into longitudinally aligned segments, rather it comprises one longitudinal unit, typically (but not necessarily) having at least one and possibly more than one longitudinal seam.

Herein a unit 10 which is constructed with no cross seams, i.e., as a single longitudinal unit, will be referred to as an "integrated" unit. To a certain extent, it may be viewed as a muffler assembly having a catalytic converter positioned operably therein. A unit constructed in segments aligned coaxially and joined to one another along cross seams will be referred to as a "segmented" arrangement. It will be understood that to a great extent the principles of the present invention may be applied in either "integrated" or "segmented" units or arrangements. It is an advantage of the preferred embodiment of the present invention, however, that it is well adapted for arrangement as an "integrated" unit.

As will be understood from the following descriptions, the muffler assembly 1 according to the present invention is constructed to operate effectively and efficiently both as an exhaust noise muffler and as a catalytic converter. With respect to operation as an exhaust noise muffler, many of the principles of operation are found in, and can be derived from, certain known muffler constructions. With respect to these principles, attention is directed to U.S. Pat. Nos. 3,672,464; 4,368,799; 4,580,657; 4,632,216; and 4,969,537, the disclosure of each being incorporated herein by reference.

Still referring to FIG. 1, muffler assembly 1 comprises a cylindrical casing or shell 11 of a selected predetermined length. Annular end caps 13 and 14 respectively define an inlet aperture 17 and an outlet aperture 18. The shell 11 is generally cylindrical and defines a central longitudinal axis 20. An inlet tube 22 is positioned within inlet aperture 17. The inlet tube 22 has a generally cylindrical configuration and is aligned with its central longitudinal axis generally coextensive or coaxial with axis 20. It is noted that end portion 24 of inlet tube 22 is configured in a manner non-cylindrical and described in detail hereinbelow, for advantage.

Outlet tube 26 is positioned within outlet aperture 18. Outlet tube 26 includes a generally cylindrical portion 27 aligned with a central longitudinal axis thereof extending generally coextensive with or coaxially with longitudinal axis 20.

In use, the exhaust gases are directed: (1) into assembly 1 by passage through inlet tube 22 as indicated by arrows 30; (2) into the internal region or volume 31 defined by casing or shell 11; and, (3) outwardly from assembly 1 by passage outwardly through outlet tube 26 as indicated by arrows 33. Within assembly 1 both sound attenuation (muffling) and emission improvement (catalytic conversion) occurs.

Referring to region 5, and in particular inlet tube 22 positioned therein, the inlet tube 22 is positioned and secured in place by end cap 13 and internal baffle 35. Preferably baffle 35 is constructed so as not to be permeable to the passage of the exhaust gases therethrough or thereacross. Thus, baffle 35 in cooperation with end cap 13 and shell 11 define a closed volume 37.

For the embodiment shown in FIG. 1, inlet tube 22 is perforated along its length of extension within assembly 1, i.e., that portion of the tube 22 positioned internally of end cap 13 (that is positioned between end cap 13 and end cap 14) is perforated, as indicated by perforations 38. Certain of the perforations allow gas expansion (and sound travel) into volume 37, which assists in attenuation of sound to some degree. Regions such as volume 37 may be generally referred to as "resonating chambers" or "acoustics", and similar structure positioned upstream of region 6 and also constructed and arranged for sound attenuation, will be referred to herein as "upstream acoustics."

The portion 42 of inlet tube 22 which projects inwardly of baffle 35; i.e., which extends over a portion of the volume between baffle 35 and outlet end cap 18 operates as a flow distribution construction or element 44. The flow distribution element 44 generates distribution of exhaust gas flow within volume 45, i.e., the enclosed volume of shell 11 positioned immediately inwardly of baffle 35, for advantage. Portion 42 of inlet tube 22 includes previously defined end portion 24.

Positioned immediately downstream of inlet tube 22 is catalytic converter 50. Catalytic converter 50 includes a substrate 51 having catalyst appropriately positioned thereon. The substrate 51 is gas permeable, i.e., the exhaust gases pass therethrough along the direction of arrow 53. The catalytic converter 50 includes sufficient catalyst therein to effect the desired conversion in the exhaust gases as they pass therethrough. Herein this will be referred to as "an effective amount" of catalyst. The substrate 51 is sized appropriately for this. Greater detail concerning the preferred catalytic converter 50 is provided hereinbelow.

Preferably the flow distribution element 44 is sized and configured appropriately to substantially evenly distribute exhaust flow against the entire front or upstream surface 55 of the catalytic converter 50. In this manner, lifetime of use in the catalytic converter 50 is enhanced. Also, the more effective and even the distribution, the less likelihood of overload in any given portion of the catalytic converter 50. This will facilitate utilization of a catalytic converter minimal or relatively minimal thickness, which is advantageous. By the term "substantially evenly" in this context it is meant that flow is distributed sufficiently to avoid substantial "dead" or "unused" volume in converter 50. Generally, as even a distribution as can be readily obtained, within acceptable backpressure limits is preferred.

In general, the catalytic converter 50 provides for little or no sound attenuation within the muffler. Thus, the space utilized by the catalytic converter is space or volume of little or no beneficial effect with respect to muffler operation.

Under such conditions, minimal thickness or flow path catalytic converter will be preferred, so as not to substantially inhibit muffler (attenuation) operation.

It has been determined that there is a preferred positioning of the catalytic converter 50 relative to the flow distribution element 44, for advantageous operation. In particular, most preferred operation occurs when the catalytic converter 50 is not positioned too close to the flow distribution element 44, but is also not positioned too far therefrom. Discussion of studies with respect to optimizing the position of the catalytic converter 50 relative to the flow distribution element 44 are provided hereinbelow, in detail.

For the arrangement shown in FIG. 1, flow distribution element 44 comprises end 24 of tube 22 crimped or folded into a "star" or "four finned" configuration. Such an arrangement has been used in certain types of muffler assemblies before, see for example Wagner et al. '537 referred to above and incorporated herein by reference. In general, the crimping creates closed edges 56 and facilitates flow distribution. Unlike for conventional muffler arrangements, for the embodiment of FIG. 1 this advantageous distribution is applied in order to achieve relatively even cross-sectional distribution of airflow into and through a catalytic converter 50, to advantage. As will be understood from alternate embodiments described hereinbelow, alternative flow distribution arrangements may be utilized in some applications.

The portion 60 of the muffler assembly 1 in extension between the downstream surface 61 of the catalytic converter 50 and the outlet end cap 14 is referred to herein as the downstream acoustical or attenuation segment or end 7 of the assembly 1. It is not the case that all sound attenuation which occurs within the assembly 1 occurs within this region. However, the majority of the sound attenuation will occur in this portion of the assembly 1.

In general, the downstream acoustical segment 7 comprises structure placed to facilitate sound attenuation or sound control. In typical constructions, resonating chambers or the like will be included therein. One such construction is illustrated in FIG. 1. The particular version illustrated in FIG. 1 utilizes a sonic choke arrangement 65 therein in association with resonating chambers, to achieve sound attenuation. It will be understood that a variety of alternate arrangements may be utilized.

Referring more specifically to FIG. 1, acoustical or attenuation segment 7 includes therein a converging or sonic choke arrangement 65 supported by sealed baffle 66. In general, the volume 68 upstream from sealed baffle 66 will be constructed or tuned for advantageous low frequency sound attenuation. Such tuning will in general concern the precise location of the sealed baffle 66, i.e., adjustment in the size of volume 68. Constructions in which a sonic choke assembly similar to that illustrated as 65 are positioned within a muffler assembly 1 by a sealed baffle 66 advantageously, are described in U.S. Pat. Nos. 3,672,464 and 4,969,537 incorporated herein by reference.

In general, sonic choke assembly 65 comprises a tube member 75 mounted coaxially with outlet tube 26 and, together with outlet tube 26, supported by baffles 66 and 77, and outlet end cap 18. In certain constructions such as that shown in FIG. 1, tube member 75 may comprise an extension of an overall tube having no cross seam which includes both the tube member 75 and the outlet tube 26 as portions thereof. Alternately stated, for the embodiment shown in FIG. 1, the outlet tube 26 comprises an end portion of tube member 75. In the alternative, the outlet tube 26 may comprise a separate extension of material from tube member 75; the outlet tube and tube member being joined along a cross seam such that they are oriented substantially coaxial with one another.

For the embodiment shown, the tube member 75 defines a central longitudinal axis positioned generally coextensive and coaxial with axis 20. In some constructions, a tube member 75 with a longitudinal axis off-set from alignment with the inlet axis may be used.

Still referring to FIG. 1, tube member 75 in combination with outlet tube 26 defines exit flow for exhaust gases passing along the direction of arrow 53 through catalytic converter 50. More specifically, such gases pass through an interior 80 of the tube member 75 and outwardly through outlet tube 26, as indicated at arrows 33.

Between baffles 66 and 77, and externally of tube member 75, a volume 85 is defined within shell 11. An extension 88 of the combination of tube member 75 and outlet tube 26 extending through volume 85 is perforated as shown by perforations 84, to allow for expansion of gases into volume 85. Volume 85 will operate as a resonator or resonating chamber for attenuation of sound, in particular continued attenuation of low frequency and much of the medium frequency attenuation. The size of the volume 85 may be selected so that it is tuned for preferred sound attenuation including some high frequency attenuation as well.

Similarly, between baffle 77 and end cap 14 chamber 90 is defined, externally of tube member 75 and outlet tube 26, and internally of shell 11. The portion 91 of outlet tube 26 extending between baffle 77 and end cap 14 is perforated, to allow expansion of gases (and leakage of soundwaves) into volume 90. The size and configuration of volume 90 may be tuned for selected medium and high frequency sound attenuation.

Still referring to FIG. 1, tube member 75 includes a conical end 92 which converges from point 93 to neck 94, i.e., it converges in extension toward the catalytic converter. On the opposite side of neck 94 from point 91, the tube member 75 diverges at flange 95 to lip 96; lip 96 defining a re-entry port for gasses passing through assembly 1. Such a construction is advantageous for preferred muffler operation and sound attenuation. As indicated above, such a construction is referred to herein as a sonic choke. Sonic chokes are described generally in Rowley et al. U.S. Pat. No. 3,672,494, incorporated herein by reference.

In general, a portion of the soundwaves existing in the gaseous medium of volume 31 are inhibited from passing through the tube member 75 by increased acoustical impedance encountered at the narrow neck 94. Such waves are reflected back, which serves to attenuate the sound level.

The Construction of the Catalytic Converter

As indicated generally above, a variety of constructions may be utilized for the catalytic converter 50. One such construction is illustrated in FIGS. 1 and 3. An alternate construction is presented by FIGS. 6 and 7.

For the embodiment of FIGS. 1 and 3, the catalytic converter 50 comprises a ceramic structure having a honeycomb-like configuration defining a plurality of longitudinal flow channels extending therethrough. Referring to FIG. 3, the ceramic construction is indicated generally at 100. For mounting within the assembly 1, the ceramic core 100 is provided in a circular configuration, i.e., core 100 defines a cylindrically shaped item. Although alternate configurations are possible, the cylindrical one described and shown is advantageous for positioning within a cylindrical shell 11.

A ceramic cylinder having a large plurality of longitudinal channels extending therethrough is a somewhat brittle configuration. It is therefore preferably mounted such that it will be dampened from the shocks and vibrations generally associated with a muffler assembly in a diesel powered vehicle. For the arrangement of FIGS. 1 and 3, the ceramic core 100 is provided with a dampening mantle or wrap 101 in extension around an outer periphery 102 thereof. The mantle 101 should be provided from a flexible, heat resistant material, such as a vermiculite pad. The material Interam® Mat III available from 3M, St. Paul, Minn. 55144 is usable. In general, for the arrangement shown the mantle 101 would be about 0.12 in. (0.3 cm) to 0.25 in. (0.64 cm) thick.

For the preferred embodiment the mantle 101 is retained against the core 100 by retaining means such as a cylindrical casing 105 of sheet metal. Preferably the casing 105 is provided not only in extension around the outside of the mantle 101, but also with a pair of side flanges bent toward the front face 55 and rear face 61, respectively, of the core 100 to contain the mantle 101. That is, casing 105 has first and second side lips or rims 106 and 107 folded toward opposite sides of the core 100. Preferably a circular loop of rope or O-shaped gasket 109 is provided underneath each of the rims 106 and 107, to facilitate secure containment of the core 100 and mantle 101 within the casing 105, without damage.

Referring to FIGS. 1 and 3, it will be understood that the preferred catalytic converter 50 illustrated is a self-contained or "canned" unit, positioned within shell 11. The converter comprises a ceramic core 100 positioned within a casing 105, and protected therein by the mantle 101 and rope rings 109. The converter 50 can thus be readily welded or otherwise secured and placed within shell 11, with good protection of the core 100 from extreme vibrations within the assembly 1. In addition, the mantle 101 and rings 109 will help protect the converter 50 from premature deterioration due to flow erosion.

In a typical system, it is foreseen that the ceramic core 100 will comprise an alumina magnesia silica (crystalline) ceramic, such as cordierite, extruded from a clay, dried and fired to a crystalline construction. Techniques for accomplishing this are known in the ceramic arts. In many, crystalline ceramics are prepared as catalytic converter cores by application of a wash coat thereto and then by dipping the core into a solution of catalyst. In some, the wash coat and catalyst are applied simultaneously. Typical catalysts utilized would be noble or precious metal catalysts, including for example platinum, palladium and rhodium. Other materials such as vanadium have also been used in catalytic converters.

In general, for use within a diesel engine muffler assembly, it is foreseen that the core 100 should be extruded with a cell density of longitudinal passageways of 200 cells/in$^2$ to 600 cells/in$^2$ and preferably at least about 400 per square inch of front surface area.

As indicated above, alternate constructions for the catalytic converter may be utilized. One such alternate construction would be to construct the core from a metallic foil substrate, rather than a ceramic. This will be understood by reference to FIGS. 6 and 7.

Figure 6:
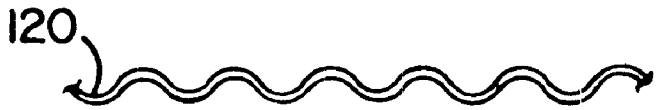
FIG. 6 is a fragmentary view of a substrate from which certain catalytic converters utilizable in muffler arrangements according to the present invention may be prepared.
Figure 7:
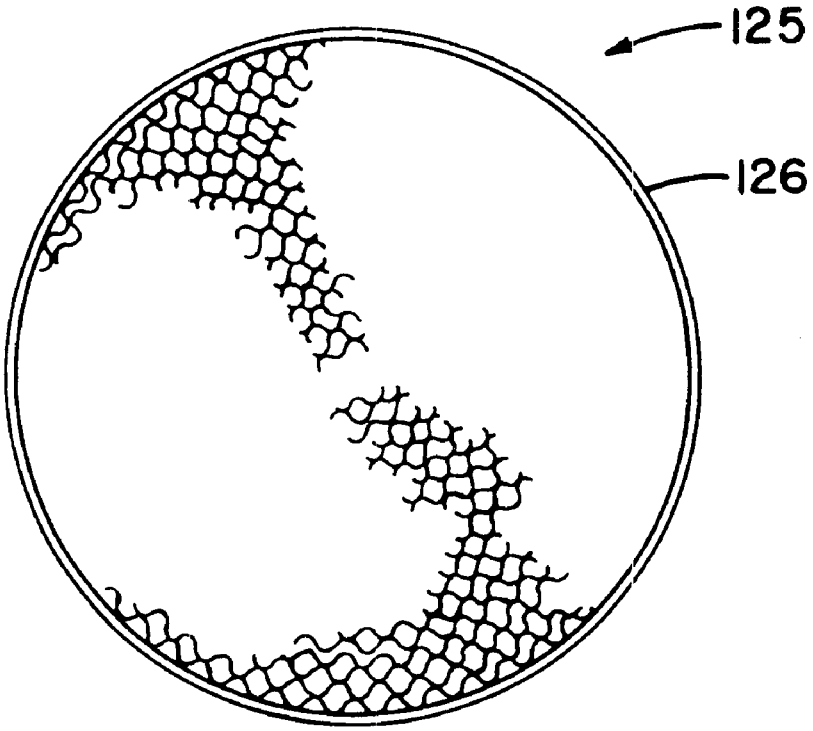
FIG. 7 is an end view of a catalytic converter prepared utilizing a substrate similar to that shown in FIG. 6; the catalytic converter of FIG. 7 being usable in an arrangement such as that shown in FIGS. 1, 4 and 5.

In FIG. 6, a side or edge view of a corrugated metal substrate 120 usable to provide a catalytic converter is shown. In general the substrate 120 should comprise a relatively thin metal such as a 0.001–0.003 inch (0.003–0.005 cm) thick sheet of stainless steel that has been corrugated to make wells of a size such that when coiled around itself, as indicated in FIG. 7, about 200 cells/in$^2$ to 600 cells/in$^2$ and preferably at least about 400 cells per square inch will result. Thus, referring to FIG. 7, the catalytic converter 125 depicted comprises a sheet of material, such as that illustrated in FIG. 6, which has been coiled upon itself and braised to retain the cylindrical configuration. Since the construction is not brittle, but rather is formed from sheet metal, a mounting mantle is not needed around the outside of the construction, for protection from vibration. The coil or construction may be surrounded with an outer casing 126 if desired, and then mounted within a muffler assembly such as that shown in FIG. 1, similarly to catalytic converter 50. It is foreseen that in general the catalyst can be applied to the metal substrate 120 in a manner similar to that for the substrate, i.e., by use of a wash coat followed by dipping in a catalyst.

Alternate Constructions for the Flow Distribution Element

Figure 8:
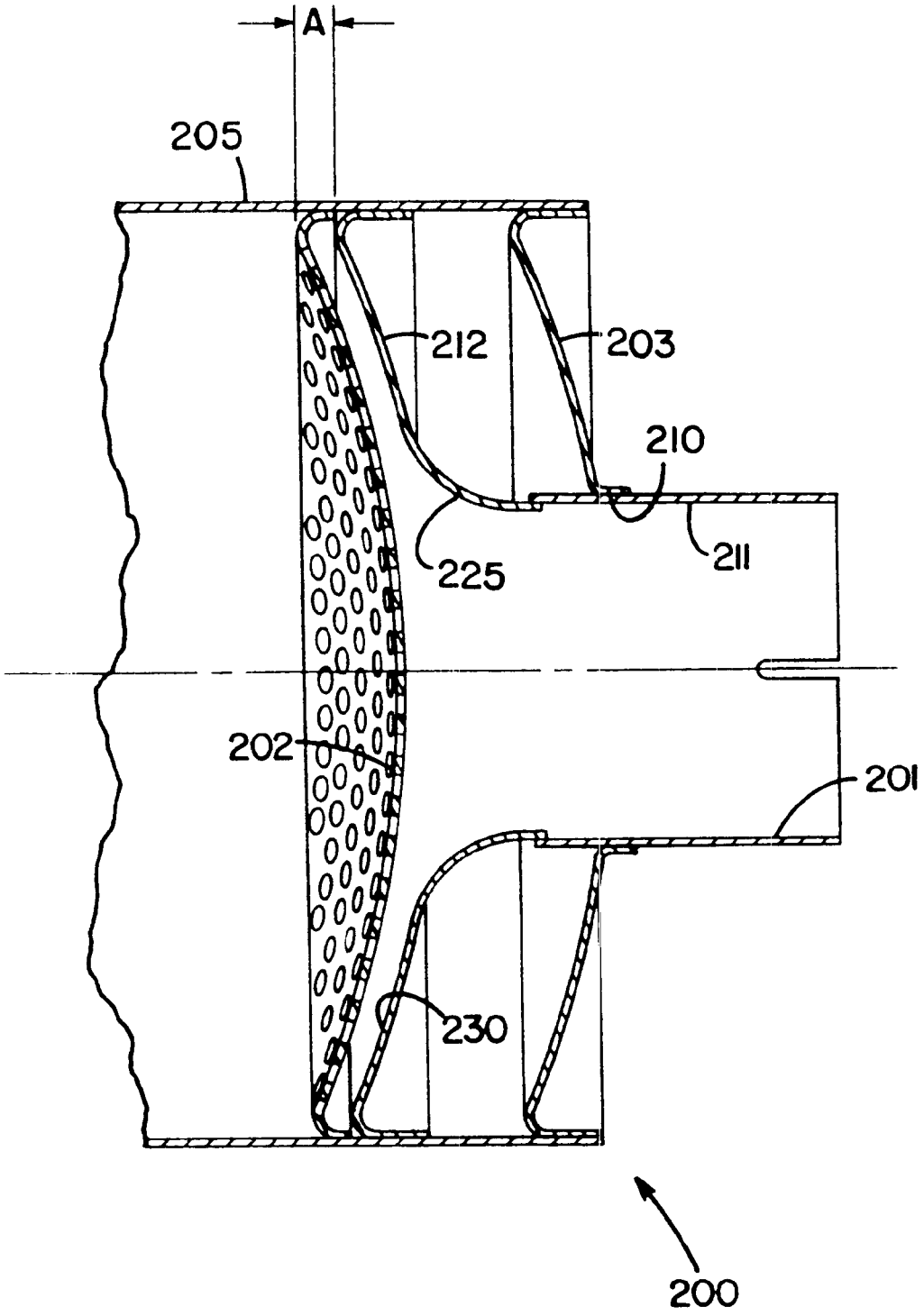
FIG. 8 is a fragmentary cross-sectional view of a radial diffuser inlet useable in an arrangement analogous to that shown in FIG. 1.

As indicated generally above, it is foreseen that alternate constructions and configurations for the flow distribution element may be utilized in assemblies according to the present invention. First, second and third such alternate configurations are illustrated in FIGS. 4, 5 and 8.

Figure 4:
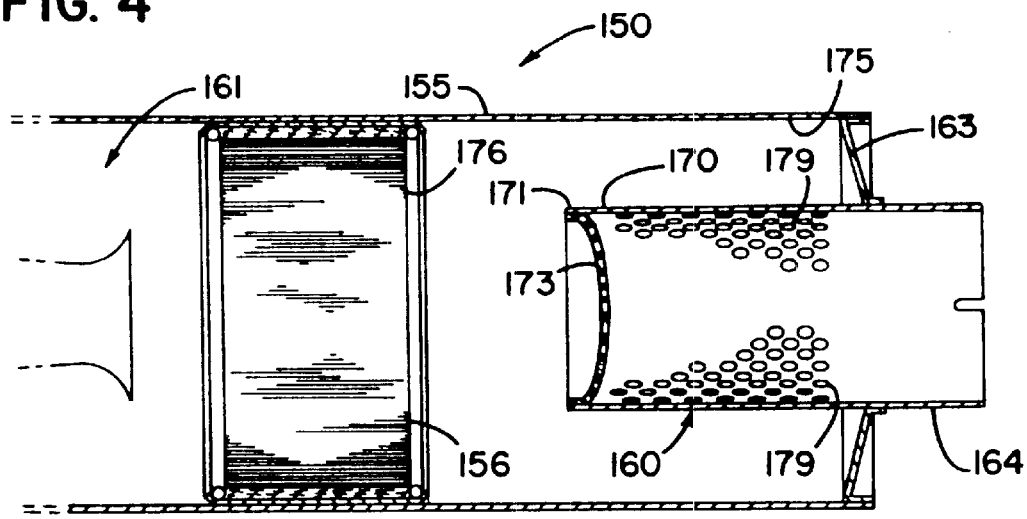
FIG. 4 is an enlarged fragmentary view of a muffler assembly with catalytic converter arrangement generally analogous to that shown in FIG. 1.
Figure 5:
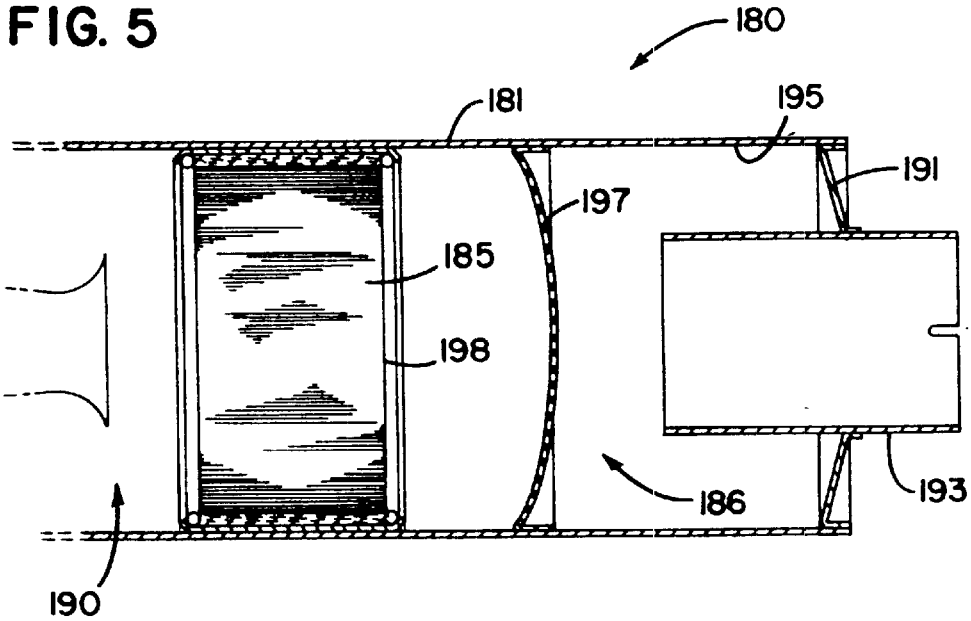
FIG. 5 is an enlarged fragmentary view generally analogous to FIG. 4.

Referring to FIG. 4, a muffler assembly 150 according to the present invention is depicted. The assembly 150 is in many ways analogous to that illustrated at reference numeral 1, in FIG. 1. In FIG. 4 the assembly 150 is depicted fragmentary; the portion of the assembly not concerning the flow distribution element and catalytic converter, but rather concerning the downstream acoustics being fragmented (not shown). It will be understood that the portion of the assembly 150 not depicted in FIG. 4 may be substantially the same as that illustrated for assembly 1 in FIG. 1 or it may be according to variations such as those mentioned above.

Referring to FIG. 4, the assembly 150 comprises an outer shell 155 which contains therein a catalytic converter 156 positioned between a flow distribution element 160 and a downstream acoustics 161. The flow distribution arrangement 160 is mounted within shell 155 by end cap 163 and comprises in part inlet tube 164.

In the arrangement shown in FIG. 1, flow distribution arrangement 160 comprises cylindrical tube 170 perforated in a portion thereof positioned within shell 155. Flow distribution element 160 is not crimped as is the arrangement of FIG. 1. Rather, the cylindrical end 171 is closed by perforated cover 173. Cover 173 is of a bowed, domed or radiused configuration, with a convex side thereof projected toward end cap 163 and a concave side thereof projected toward catalytic converter 156. This configuration is advantageous, since it inhibits "oil canning" or fluctuation under heavy flow and vibration conditions.

It will be understood that flow distribution arrangement 160 operates by allowing gas expansion through apertures 174 into volume 175. The distribution of apertures 174 (and the distribution of apertures in domed cover 173) may be used to define a preferred, even distribution of gas flow in region 175 and thus toward surface 176 of catalytic converter 156.

As indicated above, still another alternate construction is illustrated in FIG. 5. Similar to FIG. 4, the depiction of FIG. 5 is of that portion of the assembly concerning the flow distribution arrangement and catalytic converter.

Referring to FIG. 5, muffler assembly 180 comprises an outer shell 181 containing catalytic converter 185, flow distribution arrangement 186 and downstream acoustics 190. Assembly 180 includes inlet end cap 191 supporting inlet tube 193 therein.

For the construction of FIG. 5, inlet tube 193 comprises a cylindrical tube extending through end cap 190 to interior volume 195. Flow distribution arrangement 186 comprises a domed baffle 197 extending completely across shell 181 and oriented with a convex side thereof projected toward tube 193. The baffle 197 is perforated and acts to distribute flow evenly, in direction toward surface 198 of catalytic converter 185. The population density and arrangement of perforations in the domed baffle 197 can be selected to ensure even flow distribution.

Radial Diffuser Inlets

Figure 9:
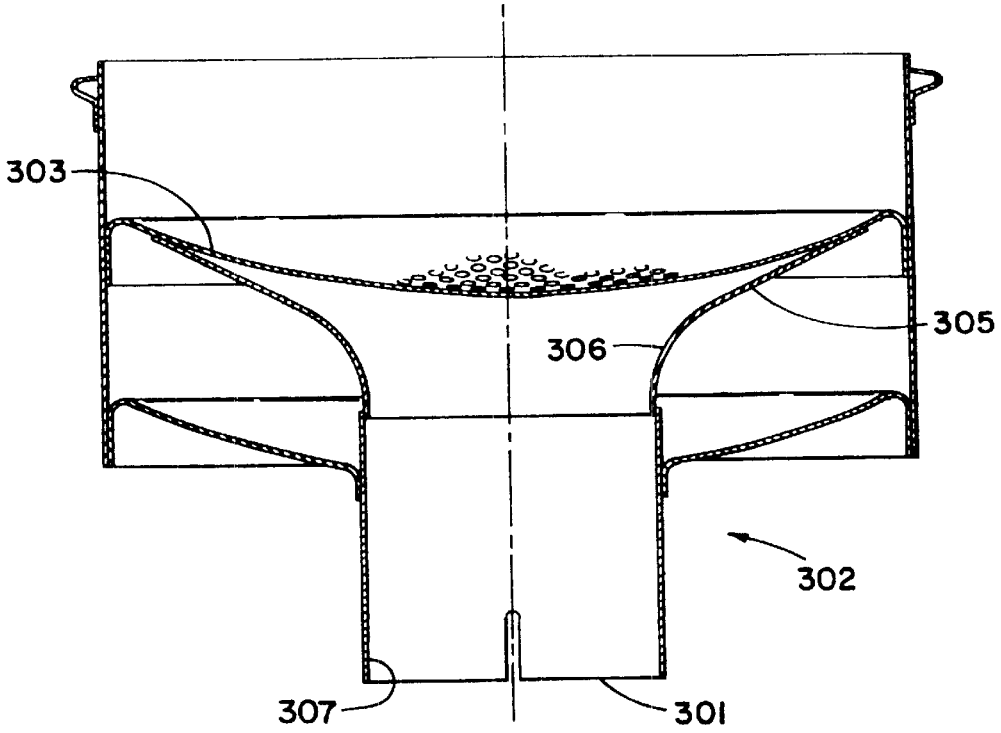
FIG. 9 is a fragmentary cross-sectional view analogous to FIG. 8, of an alternate radial diffuser element.
Figure 10:
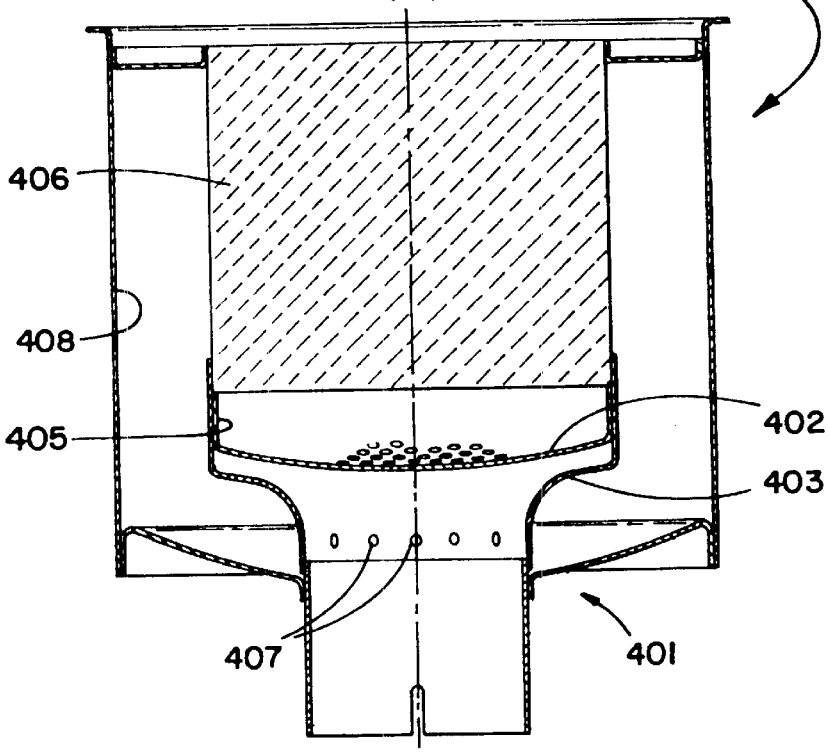
FIG. 10 is a view analogous to FIGS. 8 and 9 of a third radial diffuser element.

In FIGS. 8, 9 and 10 unique radial diffuser inlets or constructions are illustrated. A radial diffuser allow for controlled expansion of gases passing from an inlet of a first diameter to a volume of a second, larger, diameter. In general, radial diffuser inlets are presented herein as new designs for the inlet section of a muffler, whether the muffler is an acoustic exhaust muffler or catalytic converter muffler. That is, while they may be utilized mufflers containing catalytic converters therein, they may also be utilized in other types of mufflers. When used as part of an arrangement having catalytic converter therein, generally the radial diffuser inlet would be located immediately upstream of the catalyst substrate.

In general a radial diffuser inlet directs and guides the inlet fluid (typically exhaust gas) into the muffler. The result of this is a relatively uniform fluid (gas) velocity distribution across the diameter of the muffler shell (i.e. the face of the converter for an arrangement having catalytic converter therein) in the region downstream of the inlet baffle. A uniform velocity distribution is highly desirable at the inlet, especially of a catalytic substrate or core. In general, it is foreseen that a catalyst core would preferably be located within about 2 to 4, most preferably about 2 to 3, inches of the inlet baffle.

The radial diffuser construction may be utilized at the inlet end of an arrangement similar to that previously described with respect to FIG. 1, or variations mentioned herein. The radial diffuser inlet 200 of FIG. 8 comprises inlet member 201, flow distribution element 202, and end cap 203. Assembly 200 is shown mounted within shell 205.

End cap 203 defines an aperture 210 through which air inlet member 201 projects. Air inlet member 201 includes an inlet portion 211 and a flow distribution portion 212.

Flow distribution element 202 is generally curved in cross-section (preferably radial) with a concave side thereof directed toward downstream acoustics. The member is sufficiently perforated (preferably evenly) to allow desired gas flow therethrough. The extent of curvature should generally be sufficient to avoid "oil canning" and achieve desired distribution of flow.

The unique construction of radial diffuser inlet 200 is greatly attributable to diffusion flange 212 (or bell-shaped flange) which extends outwardly from inlet tube 211, as a bell, around curve 225 to obtain a bell portion spaced from and generally juxtaposed with the concave side of member 202. The bell portion of member 212 is generally indicated at 230.

Radial diffuser inlet construction 200 generally allows for a good even flow of air against porous distribution element 202, with effective flow distribution over the cross-section of shell 205, for efficiency. It will be understood that highest efficiency can be obtained from modification of various dimensions and parameters. From the following recited example, general principles of construction will be understood.

Assuming a shell having an inside diameter of 11 inches (27.4 cm) and a radial diffuser intended to operate across the full diameter of the shell, the inside diameter of the inlet portion 211 would be about 4 inches (11 cm). Curve 225 to form bell 230 would be constructed on a radius of 1.5 inches (3.81 cm). The overall length of the straight portion of inlet tube 211 would be about 3.75 inches (9.4 cm). The distance between bell 230 and diffusion element 202, if measured as illustrated at "A" would be about 0.38 inches (0.96 cm).

In FIG. 9 an alternate design of a radial diffuser inlet is indicated. In general, the inlet is indicated at reference numeral 302. It is foreseen that the design indicated in FIG. 9 would be somewhat less expensive to manufacture than the design at FIG. 8 due to simplified integration of its perforated baffle 303 with the sidewalls 305. Otherwise, it is foreseen that the dimensions the dimensions may be generally as indicated above. More specifically, it is foreseen that the radius of curvature for curve 306 would be about 1.5 inches (3.8 cm); and, the diameter of inlet end 307 would be about 4 inches (11 cm), for an arrangement wherein the diameter of the shell is about 11 inches (27.4 cm).

If the catalyst substrate downstream from the radial diffuser inlet is substantially smaller than the muffler body, a design similar to that indicated in FIG. 10 could be utilized for the radial diffuser. In particular, in FIG. 10 the muffler is indicated generally 400; and, the radial diffuser inlet is indicated generally at 401. The curved perforated baffle 402 in combination with bell 403 provides the diffusion of gases across region 405. A converter core having a smaller diameter than the shell 400 is indicated generally at 406.

The arrangement shown in FIG. 10 is also a resonator. In particular, some sound attenuation is provided by holes 407 which allow expansion into volume 408. Through various methods, the construction can be tuned to muffle desired frequencies, especially those likely to be presented by an engine with which arrangement 400 would be associated.

Figure 11:
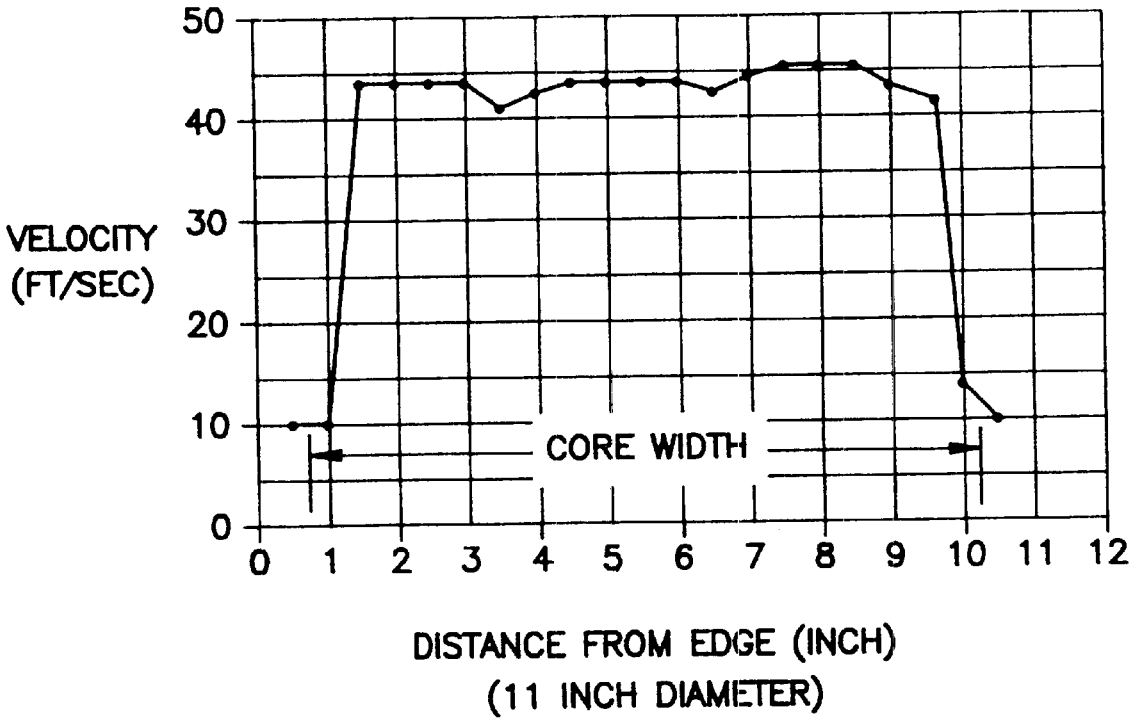
FIG. 11 is a graph reflecting the results of a test conducted with a radial diffuser element.

Operation of the radial diffusers was tested. In particular, flow through an 11 inch diameter shell fitted with a resonator generally corresponding to the design illustrated in FIG. 9, with a perforated bell having a diameter of 9.5 inches (24 cm) was conducted. In FIG. 11 a velocity of flow measured across the core width is indicated. It is apparent that except for at the edges, there was substantially uniform velocity of flow across the width of the core.

From these examples of dimensions, one of skill can create a variety of sizes of radial diffuser inlets for utilization in a variety of muffler constructions.

Size of the Catalytic Converter and its Positioning Relative to the Downstream Acoustics and Flow Distribution Element In general, catalyst activity is a function of temperature. That is, a catalytic converter generally operates best when it is hottest (within design limits). Thus, since the inlet end of a muffler assembly is hotter than the outlet end, it is generally preferable to position the catalytic converter toward the inlet end of the arrangement to the extent possible. Thus, for the arrangements shown in FIGS. 1, 4, 5 and 8 the catalytic converter is generally positioned adjacent the flow distribution element.

However, if the catalytic converter is positioned too close to the flow distribution element, inefficient use will result, due to inefficient spread of flow across the front surface of the catalytic converter. In general it is foreseen that for diesel engine truck muffler assemblies according to the present invention, the catalytic converter will be generally preferably positioned within a distance of about 2–4 inches (5–10 cm), preferably about 2.0–3.0 inches and most preferably around 2.0 inches (5.0 cm) from the flow distribution element. The results of some simulated modeling and calculations with respect to this are presented hereinbelow.

Also, in general the catalytic converter takes up space in the muffler assembly otherwise utilizable for low-frequency sound attenuation. Since the catalytic converter does not facilitate sound attenuation and since sound attenuation will not generally take place in the space occupied by the catalytic converter, a problem with the catalytic converter positioning is that it interferes with sound attenuation. It is desirable, therefore, to render the catalytic converter as short as reasonably possible. This is facilitated by assuring good flow distribution across the front surface of the catalytic converter, as indicated above, and also by positioning the catalytic converter where it will operate at the hottest and thus most efficient. In general it is foreseen that a catalytic converter utilizable in assemblies according to the present invention (as converters in muffler assemblies for diesel trucks) will need to be about 3.0–8.0 inches (7.6–20.3 cm) long and generally preferably about 5.0–6.0 inches (12.7–15.2 cm) long. It is foreseen that, therefore, in preferred constructions according to the present invention (for diesel engine mufflers) the muffler assembly will be about 5.0–6.0 inches (12.7–15.2 cm) longer than would a muffler assembly not having a catalytic converter positioned therein but utilized to achieve the same level of sound attenuation in a diesel engine exhaust stream.

To improve efficiency, and thus shorten the length of core needed, it is also preferred that the population density of pores through the core be as high as reasonably obtainable. Thus, high porosity (with a large population of very small pores) is generally preferred.

As indicated generally above, it is preferred that the catalytic converter be integrated with the muffler assembly, i.e., positioned therein, rather than positioned simply in a flow stream in series with a muffler assembly. The reasons for this include that it is foreseen that less overall backpressure will be generated by such a system.

Experiments

To examine the importance of the distance between the converter element (core member) and the flow distribution element, computer models were developed. The models were based upon an arrangement corresponding generally to that shown in FIG. 5.

In the following table the value of X is the distance (in inches) between the end of inlet element 193 and domed distribution element 197. Y is the distance (inches) between the center of dome distribution element 197 and the upstream face 198 of core member 185. Z is the distance (inches) between the core member 185 and the re-entry port of the downstream acoustics 190. A is the open area fraction (in %) of the flow distribution element.

The substrate for the purposes of the experiment was a 10.5 in. by 6 in. substrate comprising a ceramic with a platinum catalyst. It was 400 cells/in$^2$ with a wall thickness of 0.0065 inches. The conditions assumed for the computer modeling were 938° F., 637 standard cubit feet per min (SCFM).

| RUN # | X | Y | Z | A |
|---|---|---|---|---|
| 1 | 2 | 2 | 2 | 17.4 |
| 2 | 2 | 3 | 4 | 19.6 |
| 3 | 2 | 4 | 6 | 33 |
| 4 | 4 | 2 | 4 | 33 |
| 5 | 4 | 3 | 6 | 17.4 |
| 6 | 4 | 4 | 2 | 19.6 |
| 7 | 6 | 2 | 6 | 19.6 |
| 8 | 6 | 3 | 2 | 33 |
| 9 | 6 | 4 | 4 | 17.4 |

The flow distribution analysis indicated that the distance X and the open area A have a strong influence on flow distribution and the distances Y and Z have weaker but correlated affects on flow distribution. Thus optimization is feasible.

What is claimed is:

1. An exhaust treatment apparatus comprising:

an outer shell;

an inlet pipe for directing an exhaust stream into the outer shell and an outlet for allowing the exhaust stream to exit the outer shell, the inlet pipe including a pipe wall, the outlet including an outlet pipe that extends through a resonating chamber, and the outlet pipe including a sonic choke;

a core positioned within the outer shell, the core including a substrate defining a plurality of channels that extend at least partially through the core, the core also including a catalyst; and a flow distribution arrangement for distributing the exhaust stream across an upstream side of the core, the flow distribution arrangement including:

a cover that partially blocks an end of the inlet pipe, the cover defining a plurality of first flow distribution openings for allowing the exhaust stream to pass from the inlet pipe, through the cover to an interior of the outer shell; and the flow distribution arrangement also including a plurality of second flow distribution openings defined through the pipe wall of the inlet pipe for allowing the exhaust stream to pass in a radial direction from the inlet pipe, through the pipe wall to the interior of the outer shell.

2. The apparatus of claim 1, wherein the shell has an inlet end and an outlet end, and wherein the core is closer to the inlet end than the outlet end.

3. The apparatus of claim 1, wherein the inlet pipe is within 4 inches of the upstream side of the core.

4. The apparatus of claim 1, further comprising means within the outer shell for attenuating sound.

5. The apparatus of claim 1, wherein the substrate is either metal or ceramic.

6. The apparatus of claim 1, wherein the catalyst is a precious metal.

7. The apparatus of claim 1, wherein the inlet pipe is aligned along an axis that intersects the substrate of the core.

8. The apparatus of claim 7, wherein the outlet includes an outlet pipe aligned along the axis that intersects the substrate of the core.

9. The apparatus of claim 8, wherein the outer shell is cylindrical and includes a length that extends along the axis.

10. The apparatus of claim 1, further comprising an open region extending from the cover of the inlet pipe to the upstream side of the core, the open region being free of any obstructions to exhaust gas flow.

11. The apparatus of claim 1, wherein the cover is dome-shaped.

12. The apparatus of claim 1, wherein the outlet pipe has a re-entry port located adjacent to a downstream side of the core.

13. The apparatus of claim 1, wherein the inlet pipe and the outlet pipe are aligned along a common axis that intersects the substrate of the core.

14. The apparatus of claim 1, wherein the channels extend completely through the core.

15. An exhaust treatment apparatus comprising:

an outer shell;

an inlet pipe for directing an exhaust stream into the outer shell and an outlet for allowing the exhaust stream to exit the outer shell, the inlet pipe including a pipe wall;

a core positioned within the outer shell, the core including a substrate defining a plurality of longitudinal channels that extend at least partially through the substrate, the core also including a catalyst;

a flow distribution arrangement for distributing the exhaust stream across an upstream side of the core, the flow distribution arrangement including:

an end of the inlet pipe including a crushed region that is crushed radially inwardly so as to be at least partially blocked, the crushed region of the inlet pipe being within 4 inches of an upstream face of the core;

the flow distribution arrangement also including a plurality of flow distribution openings defined through the pipe wall of the inlet pipe for allowing the exhaust stream to pass in a radial direction from the inlet pipe, through the pipe wall to the interior of the outer shell;

the inlet pipe being aligned along an axis that intersects the substrate of the core; and an open region between the crushed region of the inlet pipe and the upstream face of the core, the open region being free of any obstructions to exhaust gas flow.

16. The exhaust treatment apparatus of claim 15, wherein the inlet pipe is within 2–4 inches of the upstream face of the core.

17. The exhaust treatment apparatus of claim 15, wherein the crushed region has a four-finned configuration.

18. The exhaust treatment apparatus of claim 17, wherein the four-finned configuration defines a star-shaped opening for allowing exhaust gas to exit the inlet pipe.

19. The exhaust treatment apparatus of claim 15, further comprising a sonic choke positioned downstream from the catalytic converter.

20. The exhaust treatment apparatus of claim 15, wherein the inlet pipe is within 2–3 inches of the upstream face of the core.

21. An exhaust treatment apparatus comprising:

an outer shell having a core mounting location;

an inlet pipe for directing an exhaust stream into the outer shell and an outlet for allowing the exhaust stream to exit the outer shell, the inlet pipe including a pipe wall;

a core positioned within the outer shell, the core including a substrate defining a plurality of longitudinal channels that extend at least partially through the substrate, the core also including a catalyst, the core having an upstream face positioned within 4 inches of the inlet pipe;

a flow distribution arrangement located at an end portion of the inlet pipe for distributing the exhaust stream across the upstream face of the core; and an open region extending from the inlet pipe to the upstream face of the core, the open region being free of any obstructions to exhaust gas flow.

22. The exhaust treatment device of claim 21, wherein the core includes a casing that surrounds the substrate, and wherein the casing engages the outer shell.

23. The exhaust treatment device of claim 21, wherein the inlet pipe has an inside-most end that is at least partially blocked, and wherein the inlet pipe wall defines openings for allowing the exhaust stream to pass radially from the inlet pipe, through the pipe wall, to the interior of the outer shell.

24. The exhaust treatment device of claim 23, whereby the inside-most end of that inlet pipe is crushed radially inwardly.

25. The exhaust treatment apparatus of claim 24, wherein the inside-most end of the inlet pipe is crushed in a four-fin configuration.

26. The exhaust treatment apparatus of claim 21, wherein the inlet pipe is within 2–4 inches of the upstream face of the core.

27. The exhaust treatment apparatus of claim 21, further comprising a sonic choke positioned downstream from the catalytic converter.

28. The exhaust treatment apparatus of claim 21, wherein the inlet pipe is within 2–3 inches of the upstream face of the core.

29. An exhaust treatment apparatus comprising:

an outer shell;

an inlet pipe for directing an exhaust stream into the outer shell and an outlet for allowing the exhaust stream to exit the outer shell;

a single core positioned within the outer shell, the core including a substrate defining a plurality of longitudinal channels that extend at least partially through the substrate, the core including an upstream face, the core also including a catalyst, the upstream face of the core being positioned within 4 inches of the inlet pipe;

a flow distribution arrangement at the inlet pipe for distributing the exhaust stream, the flow distribution arrangement including a flow disbursing structure positioned at an end portion of the inlet pipe; and an open region extending from the inlet pipe to the upstream face of the core, the open region being free of any obstructions to exhaust gas flow.

30. The exhaust treatment apparatus of claim 29, wherein the inlet pipe is within 2–4 inches of the upstream face of the core.

31. The exhaust treatment apparatus of claim 29, further comprising a sonic choke positioned downstream from the catalytic converter.

32. The exhaust treatment apparatus of claim 29, wherein the inlet pipe is within 2–3 inches of the upstream face of the core.

* * * * *